US006517292B1

(12) United States Patent
Landau

(10) Patent No.: US 6,517,292 B1
(45) Date of Patent: Feb. 11, 2003

(54) APPARATUS TO FORM COLUMNS OF GRANULAR MATERIAL

(76) Inventor: Richard E Landau, 768 Springfield Ave. (B-6), Summit, NJ (US) 07901

( * ) Notice: Subject to any disclaimer, the term of this patent is extended or adjusted under 35 U.S.C. 154(b) by 0 days.

(21) Appl. No.: 09/388,073

(22) Filed: Sep. 1, 1999

(51) Int. Cl.[7] ..... E02B 11/00; E02D 5/34

(52) U.S. Cl. ..... 405/233; 405/50; 405/232; 405/240; 175/20

(58) Field of Search ..... 405/50, 232, 233, 405/236, 240, 241; 175/20, 171, 323, 394; 52/155, 157, 158, 169.13, 705, 707

(56) References Cited

U.S. PATENT DOCUMENTS 2,822,671 A * 2/1958 Dentz et al. ..... 405/243
3,096,622 A * 7/1963 Landau ..... 405/50
3,300,988 A * 1/1967 Phares et al. ..... 405/241 X
3,303,656 A * 2/1967 Landau ..... 405/50
3,604,214 A * 9/1971 Turzillo ..... 175/323 X
3,648,467 A * 3/1972 Ogawa ..... 405/240
3,690,109 A * 9/1972 Turzillo ..... 405/241
3,707,848 A * 1/1973 Chelminski ..... 405/240 X
3,772,892 A * 11/1973 Ogawa ..... 405/239 X
3,772,894 A * 11/1973 Godley et al. ..... 405/50
4,269,544 A * 5/1981 Rusche ..... 405/233 X
4,311,416 A * 1/1982 Rusche ..... 405/232
4,433,943 A * 2/1984 Pao Chen ..... 405/241
4,444,278 A * 4/1984 Rocchetti ..... 175/108
4,645,381 A * 2/1987 Leflaive et al. ..... 405/258
5,242,246 A * 9/1993 Manchak, III et al. ..... 405/128
5,256,003 A * 10/1993 Ito et al. ..... 405/232
5,419,839 A * 5/1995 Haley et al. ..... 405/129.2
5,452,967 A * 9/1995 Fuller ..... 405/184
6,171,024 B1 * 1/2001 Curtis et al. ..... 405/128

FOREIGN PATENT DOCUMENTS

EP 411560 A2 * 2/1991 ..... 405/233

* cited by examiner

*Primary Examiner*—Jong-Suk(James) Lee

(57) ABSTRACT

An apparatus to install multiple small diameter columns in soil which includes a hollow shaft element to form a cavity in soil, a storage hopper to contain granular material at or near the base unit of the apparatus from which an elongated conveyor moves the granular material to a feed tank at the top of the hollow shaft element through which granular material passes as it is withdrawn from the soil to form each column of granular material. The storage hopper, the conveyor, the feed tank and the cavity forming element are arranged and move to successive column locations in a manner to permit granular material to be conveyed from the storage hopper to the feed tank without interrupting the advance and removal of the hollow shaft element from soil without rotation.

14 Claims, 1 Drawing Sheet

APPARATUS TO FORM COLUMNS OF GRANULAR MATERIAL

BACKGROUND OF THE INVENTION

This invention relates to an improvement in methods and equipment for installing small diameter columns of granular material in soil, such as used to install granular drains, which allows repetition of the column forming procedure without requiring interruption to fill the tank supplying material to the hollow shaft cavity forming tool, and configuring the equipment to induces less stress in the column forming tool to minimize potential breakdowns due to the effects of stress repetition as compared to other apparatus applicable to the economic installation of small diameter granular columns.

DESCRIPTION OF THE PRIOR ART

Equipment used for economic installation of small diameter columns of granular material in soil, as disclosed in U.S. Pat. No. 5,647,690, has an oversized hopper to contain a larger volume of backfill material in conjunction with a cavity forming tool with a small cross-section to enable formation of more than one column in soil before interrupting the cavity forming operation to refill the tank containing excess backfill material, and includes means to interrupt the flow of material after each column is formed to avoid waste of excess backfill material which is retained in the tank for use in backfilling subsequent cavities to complete added columns.

SUMMARY OF THE INVENTION

The weight of multiple columns of material in the hopper positioned on the small sized cavity forming tool may require the tool to act as a column to support the weight of the backfill tank and its contents, which causes the tool to deflect in a manner which induces stresses that may cause the tool to fracture or otherwise render it not usable for forming and backfilling cavities in an uninterrupted manner, particularly where columns need to be relatively linear and have a reasonably predictable orientation. The equipment and controls related to limiting flow of backfill from the hopper may result in maintenance problems which can also result in costs related to interruptions in equipment use.

It is the object of this invention to reduce the cost of granular column installation and increase the durability of the cavity forming tool by reconfiguring equipment disclosed in U.S. Pat. No. 5,647,690, to enable installation of multiple columns using a procedure and apparatus configuration that enables supplying backfill material for one column at a time to an intermediate hopper during the time that the cavity is being formed, which avoids interruption to production, and minimizes the weight on the hollow shaft cavity forming tool by reducing the size of backfill tank used and minimizing detrimental stress on the tool and related costs of repair and loss of equipment use, and eliminates interrupting production to periodically replenish the tank with backfill material.

BRIEF DESCRIPTION OF THE DRAWINGS

The present invention will be more fully understood by reference to the following detailed description in conjunction with the attached drawings, wherein.

It is noted that the invention may also be applied as apparatus to strengthen soil with the application of cement or a granular cement mix that is not rendered fluid by the addition of water, and will arch or not flow freely due to insufficient water or other fluid in its granular matrix.

DETAILED DESCRIPTION OF THE DRAWINGS

Figure 1:
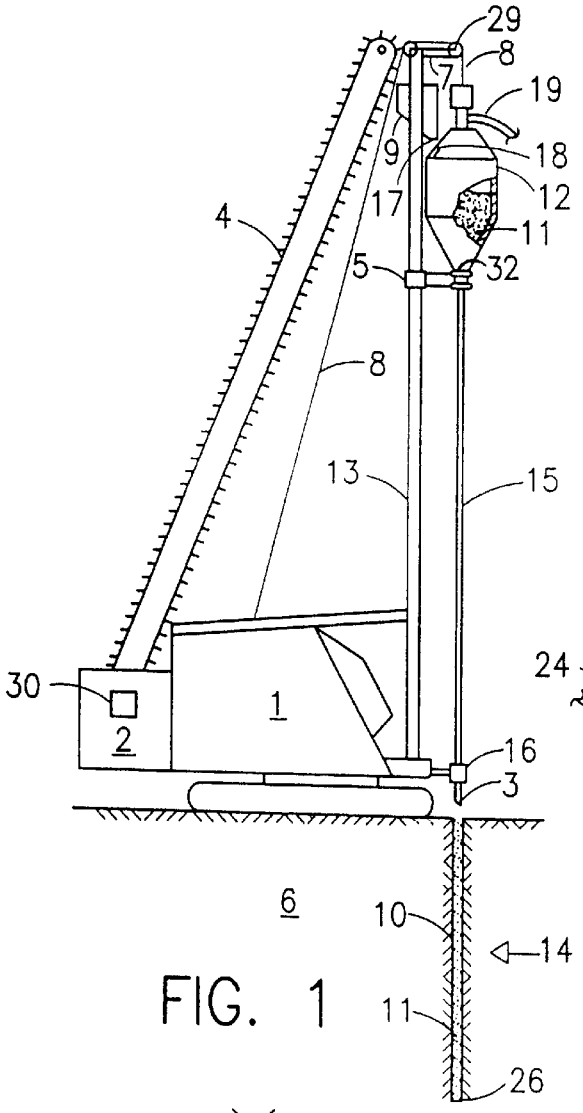
FIG. 1 shows one embodiment of the present invention which utilizes a hollow shaft or mandrel and a form of bucket conveyor and related elements to install columns of granular material, such as sand drains.

The embodiment of the invention in FIG. 1 incorporates unit 1 to provide mobile support and operational capability to the equipment which includes a backfill material storage hopper 2, track support 13, and other appurtenances. Carriage 5, which slides on track support 13, may be used to align and support tank 12 which contains material 11 used to backfill the cavity formed by a pipe or hollow mandrel 15 to form column 14. Hose 19 supplies air under pressure to tank 12 to aid in moving backfill 11 from tank 12 through mandrel 15 and into cavity 10 to form column 14. Guide 16 fixed at the lower end of unit 1 may be used to maintain the alignment of mandrel 15 during its advance and removal from soil 6. Jib 7 can be used to guide flexible cable 8 fixed to tank 12 to control travel of conjoined mandrel 15 toward and through soil 6 and its withdrawal outward from soil 6 in the column forming process. Drive 30 is positioned to operate conveyor 4 to move backfill material 11 from storage hopper 2 to hopper 9 positioned on track support 13. Hopper 9 containing backfill material 11 is aligned with its outlet 17 toward entry 18 to permit passage of backfill material 11 to depressurized tank 12 each time mandrel 15 is withdrawn from soil 6. Delivery of material by conveyor 4 to hopper 9 is monitored to deliver approximately the required amount of backfill 11 for transfer to tank 12 to form column 14. Under static conditions, backfill 11 arches at the outlet 32 at the base of tank 12 and little or no flow of granular material 11 will occur into mandrel 15. The weight of mandrel 15, tank 12, backfill material 11 and other elements moving with carriage 5 and other forces may be applied directly or indirectly to mandrel 15 when necessary to advance mandrel 15 into soil 6. Cap 3, which is initially open causing tank 12 to depressurize, is closed when mandrel 15 is positioned at the point of column formation and cap 3 contacts the soil which holds it closed during advance through the soil to the required depth 8. With cap 3 in its open position when the soil cavity 10 formed as mandrel 15 is withdrawn, air pressure or other applied means, such as vibration, causes flow of backfill material 11 from tank 12 through mandrel 15 to form the required column. In this manner, the cross-section of column 14 is expected to reflect the shape of mandrel 15. Backfill material 11 is moved upward from storage hopper 2 to hopper 9 by means of conveyor 4 operated by drive 30, during the time of column formation and until unit 1 is at its next location. Full withdrawal of the mandrel exposes the open ended mandrel and tank 12 becomes depressurized. With mandrel 15 fully extracted from soil 6 at the completion of a column and hopper 9 and its outlet 17 aligned with inlet 18 open in tank 12, backfill material 11 is again caused to flow from hopper 9 to feed depressurized tank 12 and the column forming process is repeated. The time available to move backfill material from storage hopper 2 on unit 1 by conveyor 4 to hopper 9 and backfill tank 12 positioned at the highest level of track support 13 is closely equal to the time between the start of soil cavity formation and the time unit 1 is positioned at its next location, thus avoiding interruption to the column forming cycle. Storage hopper 2 may be refilled at any time, however it is best that it holds sufficient material to have refilling done at scheduled breaks in production.

Hopper 9 may be eliminated by altering the embodiment in FIG. 1 to permit tank 12 to be temporarily separated from mandrel 15 when tank 12 reaches the point on track support 13 for conveyor 4 to supply columnar material 11 to tank 12 while mandrel 15 is advanced by its own weight or added force. Tank 12 with material 11 is repositioned on mandrel 15 on or before mandrel 15 reaches depth 26 in soil 6.

Figure 2:
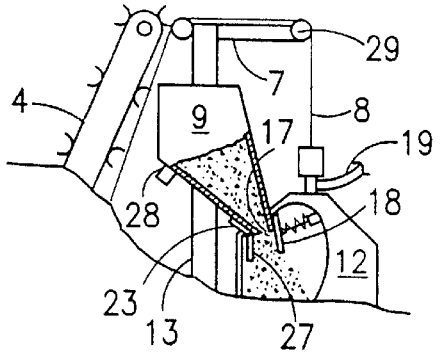
FIG. 2 shows a configuration of the backfill hopper outlet where the backfill tank portal is weighted or spring loaded to be normally closed, and is forcibly opened by the outlet of the backfill hopper when the tank is at its highest position, which occurs after each column is formed, and flow from the backfill hopper to the tank may be assisted by vibration, air flow, or other force means.

FIG. 2 shows a configuration of outlet 17 of hopper 9, where normally closed pivoted portal 27 is shaped in a manner that contact with the edge of inlet frame 23 of tank 12 opens portal 27, and outlet 17 of hopper 9 is shaped to open pivoted inlet portal 18 of tank 12 at the same time, so as to permit material 11 to pass from hopper 9 to tank 12. Special means, such as vibrator 28, may be used to expedite flow of material 11.

Figure 3:
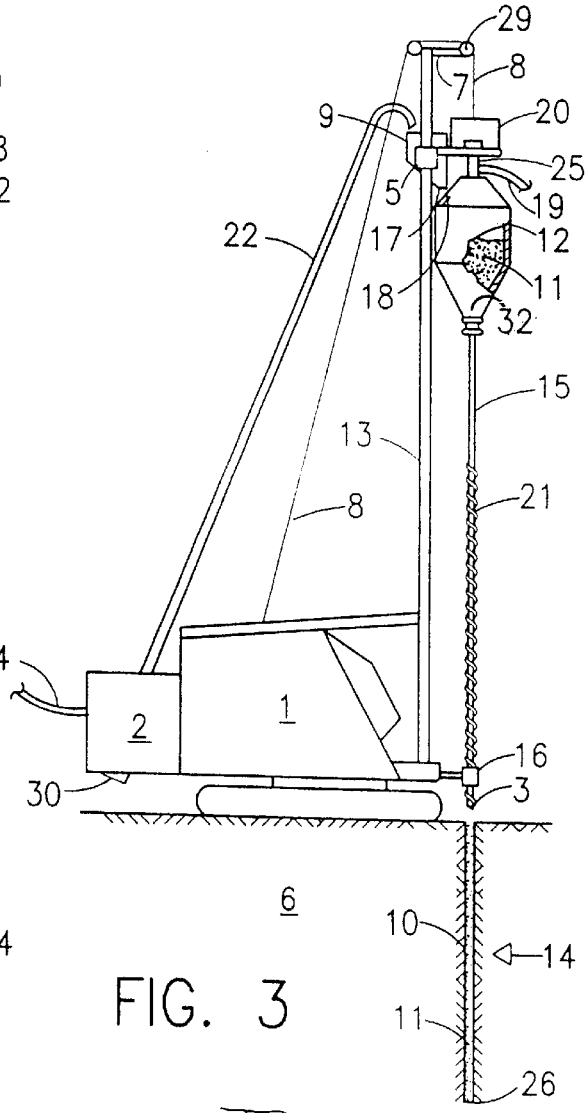
FIG. 3 is a second embodiment of the present invention which utilizes rotation to advance hollow shaft auger and a helical form of conveyor that may utilize air under pressure to flow backfill to the hopper used to feed granular material into elements related to installation of columns of material in soil.

The embodiment of the invention in FIG. 3 incorporates unit 1 to operate the equipment and provide mobile support for elements such as backfill material storage hopper 2, track support 13, and other elements such as carriage 5 to support rotary drive 20 used to rotate tank 12 and hollow stem auger 21. Hose 19 supplies air with swivel 25 to tank 12 and hose 24 may be used to provides air under pressure to storage hopper 2, if needed, is enclosed to convey granular material to backfill hopper 9. Mandrel 15 is configured with one or more helical flights to form auger 21, and guide 16 at the low end of unit 1 may be used to guide auger 21. Pulley 29 on jib 7 is used to guide flexible cable 8 fixed to tank 12 to control travel of conjoined auger 21 in the production process. Drive 30 runs conveyor 22, which may be an enclosed helical system, to move material 11 from hopper 2 hopper 9 on track support 13. The amount of material 11 moved to hopper 9 by conveyor 22 may be controlled to the amount needed to form column 14. Hopper 9 containing backfill material 11 is aligned with its outlet 17 toward entry 18 which is open when passage of backfill material 11 to depressurized tank 12 each time auger 21 is fully withdrawn from soil 6. Under static conditions granular backfill 11 arches at the base of tank 12 and little or no flow of granular material 11 will occur through the hollow shaft auger 21 without air flow or other force. To form a column, auger 21 is positioned at the point of column formation in a manner for cap 3 to be held in its closed position by the ground surface and soil 6 during its advance to depth 8. The rotation and weight of auger 21 and tank 12 with backfill material 11 apply to advance auger 21 into soil 6. Cap 3 opens when soil support is eliminated as cavity 10 forms on withdrawing auger 21. With cap 3 open, flow of air pressure or other means, such as vibration, applied at tank 12 causes and/or assists the flow of backfill material 11 from tank 12 through auger 21 and into cavity 10 to form column 14. Full withdrawal of the auger 21 from the soil is normally done without reverse rotation, and the cross-section of column 14 reflects the cylinder defined by the outside diameter of auger 21. Tank 12 becomes depressurized with the cavity forming tool out of the ground and cap 3 open to the atmosphere, and the column forming process is repeated.

Figure 4:
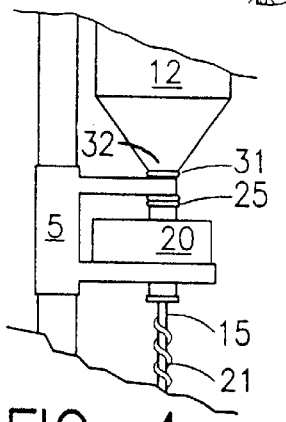
FIG. 4 supplements FIG. 2, with a variation wherein the feed tank is not required to rotate during auger advance into the soil.

FIG. 4 shows a variation of the embodiment of FIG. 1 and FIG. 3, where support 5 and drive system 20 are positioned below tank 12 where tank 12 is conjoined with swivel 25, and thrust bearing 31 if needed, in a manner to permit the passage of backfill 11 from tank 12 though swivel 25 and through the hollow mandrel 15 or auger 21. Another variation enables tank 12 to separate from mandrel 15 or auger 21, to permit feed tank 12 to be filled while the cavity forming tool is advanced to depth 26 in soil 6, either under its own weight or by application of other force. Tank 12 is repositioned on mandrel 15 or auger 21 before depth 26 is reached in soil 6.

In the embodiment of FIG. 1, cap 3 must be smaller than the outer dimension of mandrel 15 for it to open freely in formed cavity 10, and is best designed to seat at the inside of mandrel 15. Although the rate of flow of material 11 through mandrel 15 may be affected, it may be desirable to taper the outlet of mandrel 23 to reduce the size of cap 3.

Variations in methods, embodiments and equipment described and illustrated will be evident to those familiar in the art without deviating from the teachings presented in this disclosure.

One variation of this invention relates to equipment and methods commonly used in soil sampling, where successive short sections of pipe or flight augers are added to extend the depth of such shafts beyond the maximum length handled by the equipment at one time. This use of shaft segments can be applied to the hollow shaft equipment of the present invention with modifications for the needed cavity formation and fill placement teachings of the present invention which may be further varied by applying selected teachings of U.S. Pat. No. 5,647,690.

I claim:

1. An apparatus for uninterrupted formation of a column of material in soil comprising a hollow shaft means with a cap means over a soil penetrating end outlet to penetrate into and displace said soil and form a cavity as it is withdrawn from said soil, a storage hopper to hold material to fill at least one said cavity to form said column with said storage hopper in a substantially fixed position from the start of said hollow shaft means advancing into said soil until said hollow shaft means is removed from said soil while said column is formed, a conveyor means with one end at said storage hopper to convey said material for said column from said storage hopper to the other end of said conveyor means positioned to deliver said material to a tank at its highest position with an entry port to accept said material and an outlet for passage of said material to said hollow shaft means with said cap means open at said soil penetrating end outlet of said hollow shaft means to fill said cavity formed in said soil, means to support and move said tank and said hollow shaft for travel toward and away from said soil, means to align said tank to said hollow shaft to form a flow path for said material in said tank to flow through said tank outlet and through said hollow shaft, a force means to advance said hollow shaft means with said soil penetrating end outlet closed by said cap means to displace said soil during the advance to the desired depth, a force means to withdraw said hollow shaft means to form said cavity below said soil penetrating end outlet in said soil enabling said cap means to open said soil penetrating end outlet as said hollow shaft is withdrawn from said soil to extend said flow path to said cavity as said cavity is formed, means to supply fluid pressure into said tank and said entry port is closed to cause said material to flow from said tank through said flow path into said cavity until said cavity is filled as required to form said column of said material in said soil.

2. The apparatus of claim 1 wherein said conveyor means is positioned to discharge into said storage hopper configured to guide the flow of said conveyed granular material into said tank from said storage hopper where the material is replenished as needed to maintain reasonable continuity of cavity formation.

3. The apparatus of claim 2 wherein said conveyor means is configured to open said entry port of said tank to permit the transfer of said material into said tank, and allows said entry port to close as said tank is removed from said conveyor means.

4. The apparatus of claim 1 where movement of said conveyed material is assisted by air under pressure applied at said storage hopper, in which said storage hopper and said conveyor means to convey said material is enclosed with an outlet at the upper end of said conveyor means to cause said air to flow in the direction said granular material is conveyed to said tank, and said storage hopper is replenished while maintaining continuity of cavity and related column formation.

5. The apparatus of claim 1 where said tank incorporates said entry port and said outlet, said entry port being configured to open at least when said conveyed material enters said tank and to close when pressurized fluid is used to assist the flow of said material from said tank through said tank outlet into said hollow shaft means and into said soil cavity to form said column of material in said soil.

6. The apparatus of claim 1 configured for mounting on a mobile support unit to permit movement of said apparatus and said storage hopper containing said material to successive locations for said columns of said material to be installed in said soil.

7. The apparatus of claim 1 wherein compressed air is supplied to said fluid pressure supply means to cause said material to flow from said tank through said flow path and into said cavity.

8. The apparatus of claim 1 wherein said force means to advance said hollow shaft means into said soil includes soil displacement force other than weight of elements of said tank and said backfill material.

9. The apparatus of claim 1 wherein said column is defined by said hollow shaft means.

10. The apparatus of claim 1 wherein a separate force means is applied to move said tank independently when said hollow shaft means is advanced into said soil.

11. The apparatus of claim 10 wherein said force means to advance said hollow shaft means into and through said soil includes the weight of said hollow shaft means and said tank as well as the weight of said material in said tank.

12. The apparatus of claim 1 wherein said material is granular.

13. The apparatus of claim 1 wherein said material is gravel.

14. The apparatus of claim 1 wherein said material is sand.

* * * * *